US006696915B2

(12) United States Patent
Pan

(10) Patent No.: US 6,696,915 B2
(45) Date of Patent: Feb. 24, 2004

(54) KNOB COMBINED A RHEOSTAT AND A PUSHBUTTON

(75) Inventor: Francis Pan, Taichung Hsien (TW)

(73) Assignee: Forhouse Corporation, Taichung Hsien (TW)

( * ) Notice: Subject to any disclaimer, the term of this patent is extended or adjusted under 35 U.S.C. 154(b) by 13 days.

(21) Appl. No.: 10/145,859

(22) Filed: May 14, 2002

(65) Prior Publication Data

US 2003/0214381 A1 Nov. 20, 2003

(51) Int. Cl.[7] ..... H01C 10/50

(52) U.S. Cl. ..... 338/198; 338/200; 338/173; 200/530

(58) Field of Search ..... 200/530; 338/198, 338/200, 173

(56) References Cited

U.S. PATENT DOCUMENTS 2,472,604 A * 6/1949 McDonald ..... 338/198
3,557,637 A * 1/1971 Tomczak ..... 338/198
3,731,027 A * 5/1973 Arnhold ..... 307/126
4,035,759 A * 7/1977 Benthuysen ..... 338/162
4,132,129 A * 1/1979 Pratt ..... 74/553
4,398,170 A * 8/1983 Nishikawa ..... 338/198
4,439,654 A * 3/1984 Bresin et al. ..... 200/302.1
4,453,152 A * 6/1984 Dob et al. ..... 338/197
5,384,442 A * 1/1995 Danner ..... 200/566
6,410,871 B1 * 6/2002 Rarbach ..... 200/336

* cited by examiner

*Primary Examiner*—Karl D. Easthom
(74) *Attorney, Agent, or Firm*—Head, Johnson & Kachigian

(57) ABSTRACT

A knob having a button for a rheostat includes a base, at least one arcuate contacts, a hub, a pushbutton cap with a conductive arc corresponding to the arcuate contacts and a biasing member mounted in the pushbutton cap. The biasing member can be mounted between the pushbutton cap and the hub or the base to make the pushbutton cap return to its original position when pressure on the pushbutton cap is released. A rotating shaft of a rheostat extends out from the base and connects to the hub. The pushbutton cap is mounted on the hub to turn the hub and the rotating shaft to change resistance of the rheostat.

6 Claims, 2 Drawing Sheets

KNOB COMBINED A RHEOSTAT AND A PUSHBUTTON

BACKGROUND OF THE INVENTION

1. Field of the Invention rheostat

The present invention relates to a knob combined a rheostat, more specifically to a knob for a rheostat that can also function as a pushbutton.

2. Description of Related Art

Many electronic devices, such as receiver/amplifiers, transceiver, blenders and treadmills use bottoms and knobs on panels to control device functions like volume, tone speed, etc. However, the most new electronic devices have more and more functions to attract consumers. Therefore, more buttons and knobs are used on panels of the electronic devices. Because so many buttons and knobs populate the limited space on the panels, it is not easy to press the buttons or turn the knobs-without inadvertently hitting other buttons and knobs.

Therefore, the present invention provides a knob combined a pushbutton and a rheostat to mitigate or obviate the aforementioned problems.

SUMMARY OF THE INVENTION

An objective of the present invention is to provide a knob that can not only easily adjust a rheostat but can also be used as a pushbutton. Therefore the present invention can control two electronic elements. Using the knob in accordance to the present invention the panel of an electronic device can save-a considerable amount of space on the panel.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
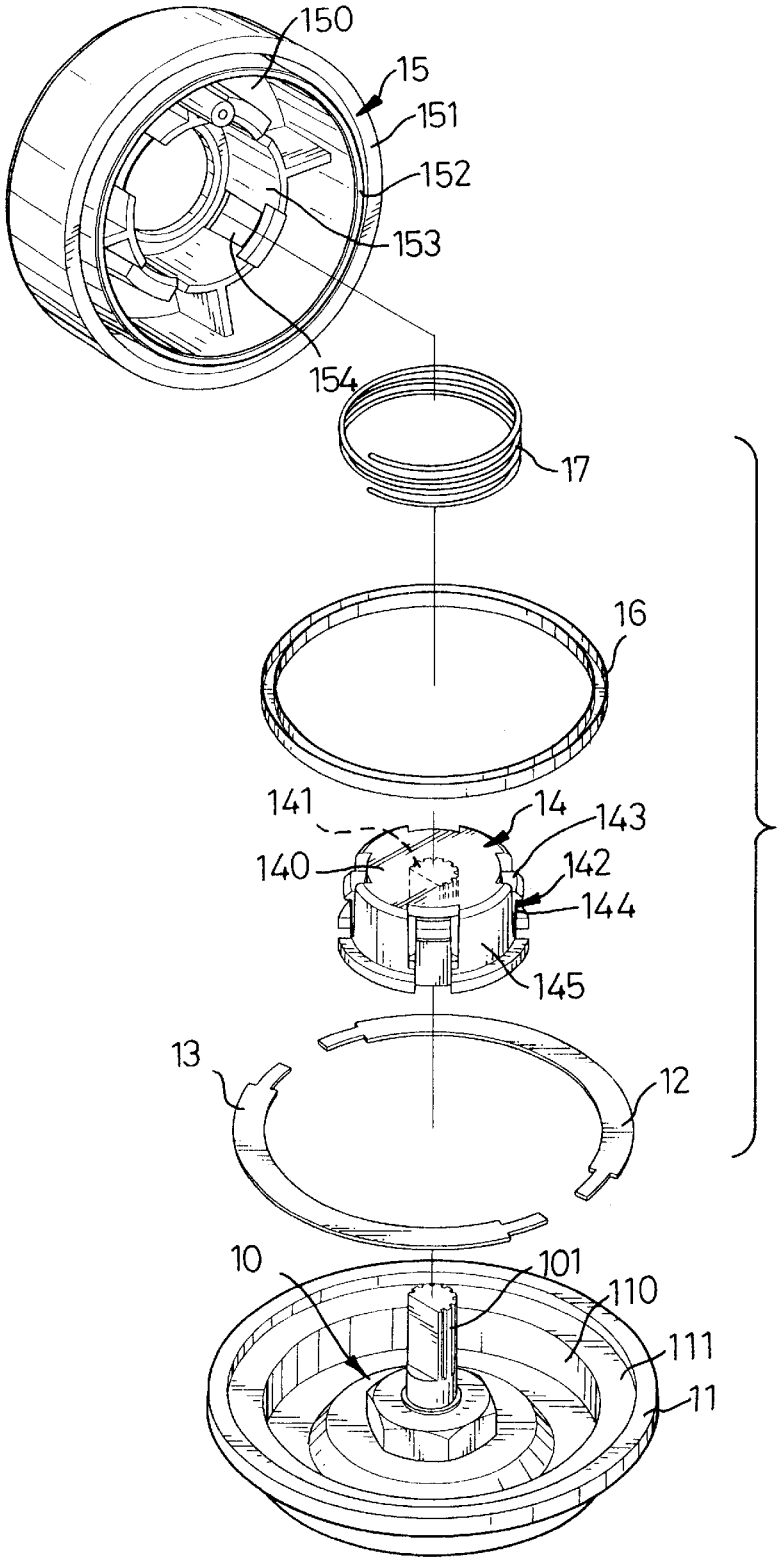
FIG. 1 is an exploded, perspective view of a knob in accordance with the present invention connected to a rheostat.

With reference to FIG. 1, a knob adapted to easily adjust a rheostat (10) comprises a base (11), at least two arcuate contacts (12, 13), a hub (14), a pushbutton cap (15) mounted on the hub (14) with a positioning device (142), and a biasing member (17).

A central through hole (not numbered) is defined in the base (11), and a rotating shaft (101) is mounted in the through hole. One end of the rotating shaft (101) extends out of the base to adjust the rheostat (10), The arcuate contacts (12, 13) are mounted on the base (11) separate from each other. The hub (14) is securely mounted on the rotating shaft (101) to turn the shaft (101) to adjust the resistance of the rheostat (10). The pushbutton cap (15) has a bottom edge (not numbered). A conductive arc (16) corresponding to the arcuate contacts (12, 13) on the base (11) is connected to the, bottom edge of the pushbutton cap (15). The biasing member (17) is mounted in the pushbutton cap (15) between the pushbutton cap (15) and the hub (14) or the base (11) to press the pushbutton cap (15) away from the base (11) when downward pressure on the pushbutton cap (15) is released. When the pushbutton cap (15) is pressed toward the base (11), the conductive arc (16) touches the arcuate contacts (12, 13) and closes a circuit between the arcuate contacts (12, 13). When pressure on the pushbutton cap (15) is released, the conductive arc (16) separates from the arcuate contacts (12, 13), and the circuit between the arcuate contacts (12, 13) is opened. Based on the forgoing description, the pushbutton cap (15) can make the circuit (not shown) two arcuate contacts (12, 13) be opened or be closed. To attain the function, the pushbutton cap (15) is able to be designed to an arcuate conductive contact (not shown) corresponded to one arcuate contact (12). That is the other arcuate contact (13) is replaced to the arcuate conductive contact. Therefore the arcuate contacts (12) mounted on the base (11) only needs one.

A chamber (110) is defined in the base (11) and communicates with the through hole (not numbered) in the base (11). An opening (not numbered) having a bigger diameter than the chamber (110) is defined in the base (11) to form a shoulder (111) in the chamber (110) of the base (11). Two l,arcuate contacts (12, 13) are mounted on the shoulder (111).

The hub (14) includes a top (140) having a bottom face (not numbered), an integral skirt (145) formed around the top (140) and extending down and a central keyed tube (141) formed on and extending down from the bottom face. Multiple L-shaped resilience keys (142) extend radially out from the skirt (145) of the hub (14). Each key (142) has a radial tab (143) and a longitudinal leg (144) on which the radial tab (143) is formed. The tube (141) has a sawtooth pattern on the inner face to securely hold the rotating shaft (101).

Figure 2B:
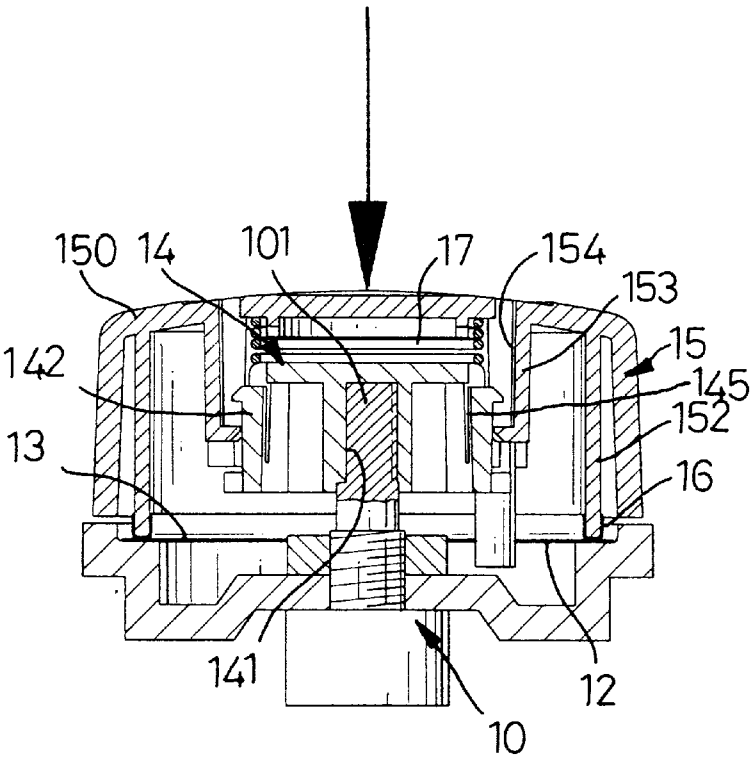
FIG. 2A and 2B are side plan views in partial section of the knob in FIG. 1.
Figure 2A:
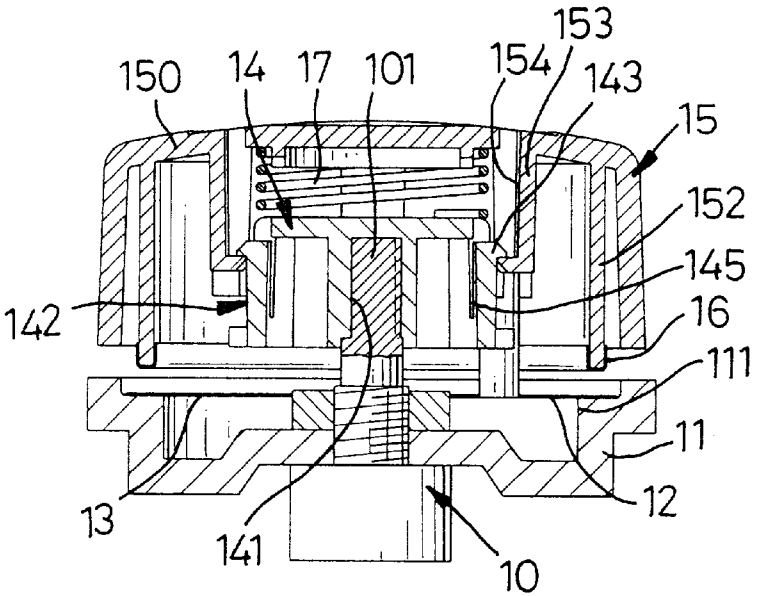

With further reference to FIG. 2A and 2B, the pushbutton cap (15) has a top (150) with an outer edge, a center, a bottom face (not numbered) and at least one skirt formed on and extending down from the bottom face of the top (150). In the preferred embodiment, there are three different diameter concentric circular skirts (151, 152, 153). An exterior skirt (151), a contact skirt (152) and a locking skirt (153) are sequentially and concentrically formed on the bottom face of the top (150) from the outer edge toward the center. The contact skirt (152) is longer than the others and has a bottom edge to which the conductive arc (16) connects. The hub (14) is slidably mounted in the locking skirt (153) that has an inside surface (not numbered). Multiple longitudinal recesses (154) corresponding to radial tabs (143) of the keys (142) are defined in the inner surface of the locking skirt (153).

The biasing member is a spring or a pair of magnets (not shown). The spring (17) is mounted inside the circular locking skirt (151). When assembling the base (11), the hub (14) and the pushbutton cap (15), the spring (17) is mounted between the hub (14) and the pushbutton cap (15).

With reference to FIG. 2A, the elements of the knob are assembled by firstly mounting the two arcuate contacts (12, 13) on the shoulder (111) of the base (11) such that the arcuate contacts (12, 13) are not in contact with each other. Then the hub (14) is pressed onto the rotating shaft (101). Before the pushbutton cap (15) is mounted on the hub (14), the conductive arc (16) must be mounted on the contact skirt (152). The spring (17) is placed inside the locking skirt (153) of the pushbutton cap (15), the keys (142) on the hub (14) are aligned with the recesses (154) inside the locking skirt (153), and the hub (14) is pressed into the locking skirt (153). When the hub (14) is completely pressed into the pushbutton cap (15), each radial tab (143) of each key (142) is held in the corresponding recess (154). The pushbutton cap (15) is able to slide on the skirt (145) of the hub (14). Since the spring (17) is mounted between the hub (14) and the pushbutton cap (15), the pushbutton cap (15) be a returnable pushbutton. The pushbutton cap (15) returns to its original position relative to the hub (14) when pressure on the pushbutton cap (15) is released. Therefore the positioning means between the pushbutton cap (15) and the hub (14) includes the resilient keys (142) on the hub (14) and the recesses (154) in the locking skirt (153) of the pushbutton cap (15).

With reference to FIG. 2B, the conductive arc (16) on the bottom edge of the circular contact skirt (152) touches the two arcuate contacts (12, 13) to short when the pushbutton cap (15) is pressed downward to the, base (11). When the pressure on the pushbutton cap (15) is released, the conductive arc (16) disconnects from the two arcuate contacts (12, 13), as shown in FIG. 2A, so that the circuit between the two arcuate contacts (12, 13) is open.

The knob not only can easily turn to change the resistance of the rheostat by turning the pushbutton cap and the hub, but also can be a pushbutton to act as a switch.

While this invention has been particularly shown and described with reference to a preferred embodiment, it is to be understood by those skilled in the art that various changes in form and details may be made therein without departing from the scope of the invention encompassed by the appended claims.

What is claimed is:

1. A knob having a button for a rheostat, said knob comprising:

a base having a through hole wherein a rotating shaft of a rheostats sticks out from the through hole;

at least one arcuate contact mounted on the base;

a hub connected to the rotating shaft and having a top and a first skirt with a positioning device integrated downward from the top;

a pushbutton cap connected to the hub and having a top and at least two concentric circular second skirts with two different diameters and different lengths, wherein one of the at least two second skirts with a smaller diameter correspond to the positioning device on the first skirt on the hub to slide up and down the first skirt of the hub and the length of the other one of the at least two second skirts with a larger diameter is longer than that of the one of the at least two second skirts with the smaller diameter and has a bottom edge on which a conductive arc corresponding to the at least one arcuate contact is mounted; and a biasing member mounted in the pushbutton cap to provide a recoverable force to the pushbutton cap, wherein the pushbutton cap returns to an original position relative to the hub when pressure on the pushbutton cap is released and breaks contact between the at least one arcuate contact on the base and the arcuate arc.

2. The knob as claimed in claim 1, wherein the positioning device includes multiple L-shaped resilience keys extending radially outward from the first skirt of the hub, wherein each key has a radial tab and a longitudinal leg; and multiple longitudinal recesses corresponding to the radial tabs of the keys and defined on an inside of the at least one second skirt of the pushbotton cap.

3. The knob as claimed in claim 1, wherein a tube having an inner face is integrally formed down from the top of the hub for inserting the rotating shaft.

4. The knob as claimed in claim 3, wherein a sawtooth pattern is formed on the inner face is to securely hold the rotating shaft.

5. The knob as claimed in claim 1, wherein the pushbotton cap includes three different diameter concentric circular second skirts respectively formed on the top, wherein the conductive arc is mounted on one of the circular second skirts that is longer than the others to easily touch the arcuate contact on the base.

6. The knob as claimed in claim 1, wherein the biasing member is a spring mounted between the pushbutton cap and the hub.

* * * * *